United States Patent [19]

Egosi

[11] 4,127,062

[45] Nov. 28, 1978

[54] OPPOSED BOX BALING PRESS

[76] Inventor: Isaac Egosi, P.O. Box 73, Kiryat Mozkin, Israel

[21] Appl. No.: 816,757

[22] Filed: Jul. 18, 1977

Related U.S. Application Data

[63] Continuation-in-part of Ser. No. 711,338, Aug. 4, 1976, Pat. No. 4,041,855, which is a continuation-in-part of Ser. No. 603,280, Aug. 11, 1975, Pat. No. 4,006,679.

[51] Int. Cl.[2] ..... B30B 15/30

[52] U.S. Cl. ..... 100/215; 100/218; 100/244; 100/245; 100/251; 100/295

[58] Field of Search ..... 100/245, 295, 244, 218, 100/215, 251, 249, 240; 53/124 R, 124 B; 141/73

[56] References Cited

U.S. PATENT DOCUMENTS

| | | | |
|---|---|---|---|
| 1,857,707 | 5/1932 | Bell | 100/249 X |
| 2,384,163 | 9/1945 | Flowers | 100/244 X |
| 3,046,873 | 7/1962 | Landis | 100/240 X |
| 3,438,319 | 4/1969 | Raab | 100/244 X |
| 3,693,541 | 9/1972 | Lombard | 100/244 X |

FOREIGN PATENT DOCUMENTS

| | | | |
|---|---|---|---|
| 569,026 | 5/1945 | United Kingdom | 100/215 |

*Primary Examiner*—Billy J. Wilhite
*Attorney, Agent, or Firm*—Watson, Cole, Grindle & Watson

[57] ABSTRACT

A baling press has opposed boxes with a tramper movable along the lint feed box for pre-packing fibrous material fed thereinto. The press box opposed to the feed box has a ram follow block against which the fibrous material is pre-packed, and which moves incrementally away from the lint box as the prepacked fiber mass accumulates. The tramper is reciprocable at a uniform stroke and has a pronged tramper head thereon for restraining the pre-packed bale in the press box as a slotted gate is closed prior to a final compression of the bale. Prepacking in the lint box may then continue for another batch during the final bale compression.

6 Claims, 9 Drawing Figures

OPPOSED BOX BALING PRESS

RELATED APPLICATIONS

This application is a continuation-in-part of U.S. application Ser. No. 711,338, filed Aug. 4, 1976, now U.S. Pat. No. 4,041,855, as a continuation-in-part of U.S. Ser. No. 603,280, filed Aug. 11, 1975 and now U.S. Pat. No. 4,006,679.

BACKGROUND OF THE INVENTION

This invention relates generally to a press for baling fibrous material, and more particularly to such a press having a fixedly mounted tramper reciprocating along the lint box at uniform strokes for pre-packing bales at substantially uniform density throughout.

Known baling presses of the single or multi-box types are typically provided with reciprocable trampers having a substantially uniform-length stroke. During the packing process, however, the material near the bottom of the lint box is of a lesser density than the packed material near the upper portion of the lint box because of the fixed "dead centers" of the tramper strokes effected by such prior art arrangements. Such an operation therefore becomes inefficient since uniform density throughout the height of the packed batch is not readily controllable. The lint box must therefore be of a larger and more complex construction.

The known baling presses moreover provide a door for exposing the compacted bale for removal, or a specially designed cylinder bears agains an opposite side of the press box for causing the fibrous material to be compressed between the lower ram and the top cylinder which closes the box. The fibrous material is then extruded out of the press box to form a compact bale while the ram is moved upwardly and the top cylinder is retracted.

Furthermore, in those opposed box baling presses having a shiftable gate between boxes, dog elements or similar retention means is required for preventing the packed fibers transferred into the lower box from bulging or swelling upwardly before the gate is closed in readiness for the lower compression ram.

SUMMARY OF THE INVENTION

It is therefore an object of the present invention to provide a baling press which avoids the difficulties of the prior art presses by an arrangement which is highly effective, easy to operate, less complex and permits the pre-packing of bales at substantially uniform density throughout.

The baling process according to the present invention has a reciprocable tramper disposed for axial movement in the lint box at substantially uniform strokes except that, as compared to the prior art presses, the present arrangement permits the packing of fibrous material into a substantially uniform density throughout the packing operation. Such is likewise made possible with the baling presses according to the aforementioned patents except that, there, the packer or tramper moves incrementally away from the press box and at uniform strokes during the packing operation. Hence, opposing dead centers of the tramper strokes move together away from the press box during the pre-packing operation relative to the amount of fiber already packed in the lint box.

The baling press according to the present invention constitutes an improvement over the presses shown in the aforementioned related patents in that the axially reciprocable tramper in the lint box is so arranged as to have substantially even-length strokes, although the dead center of the tramper strokes at the press box end gradually changes incrementally toward a fixed dead center of the opposing tramper strokes so as to likewise achieve a substantially constant fiber density of the packed fobers throughout the box depth.

In accordance with the invention, the tramper is fixedly mounted and is operated in even-length strokes although the fibers are pre-packed against the ram follow block in the press box which is valved so as to move incrementally away from the lint box as the size of the pre-packed bale increases. A slotted gate, similar to that shown in the aforementioned 1885 patent, is opened during the pre-packing operation and is closed at the completion of such operation. The tramper has a head with prongs thereon or is formed by leg members which permit the slotted gate to be closed in the path thereof while pressure is maintained on the pre-packed bale prior to compression of the fibers into a pressed bale by the press ram which is actuated to move toward the closed slotted gate. During such a pressing operation, pre-packing continues in the lint box so that, after the pressed bale is moved out of the press box, the gate is opened and pre-packing of another bale commences against the ram follow block which is moved to lie adjacent the lint box. Alternatively, the press box may be eliminated for those types of fibers which, when being pre-packed, do not need to be fully confined as with the use of a lint box chamber.

DETAILED DESCRIPTION OF THE INVENTION

Figure 1:
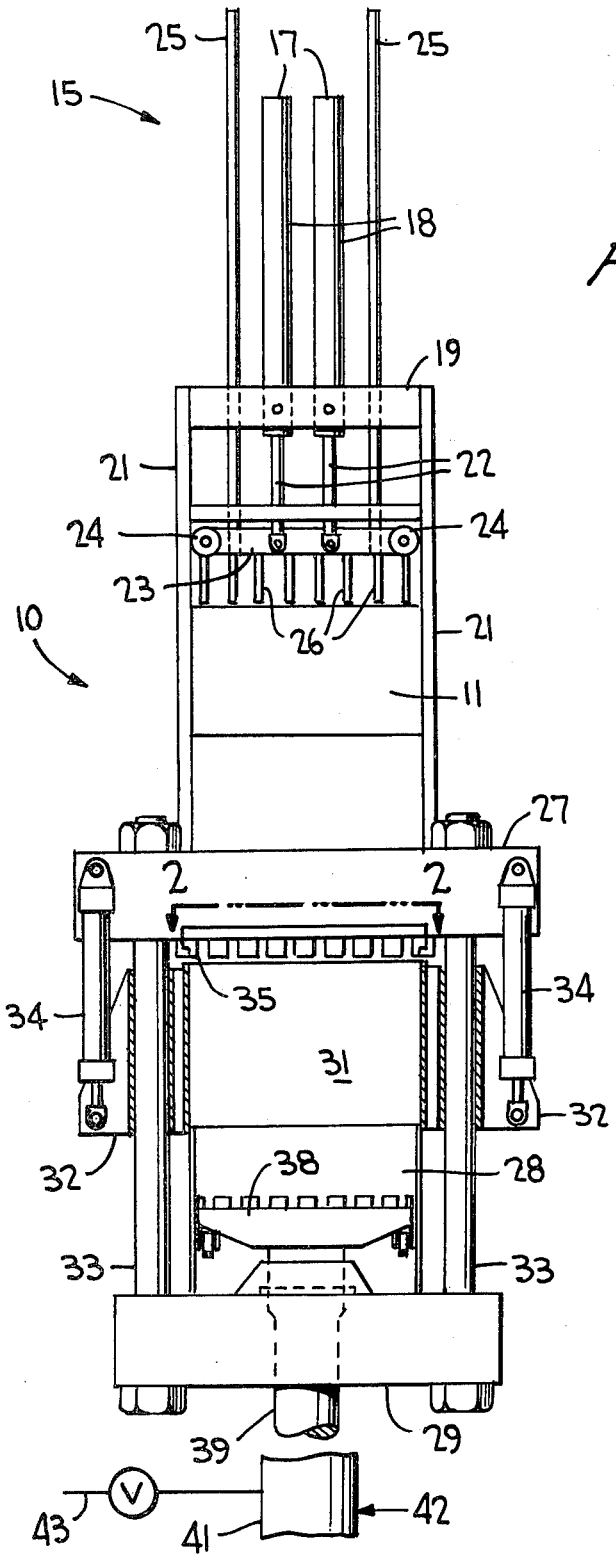
FIG. 1 is a front elevational view showing the general arrangement of the baling press in accordance with the invention.
Figures 3A, 3B, 3C, 3D, 3E, 3F:
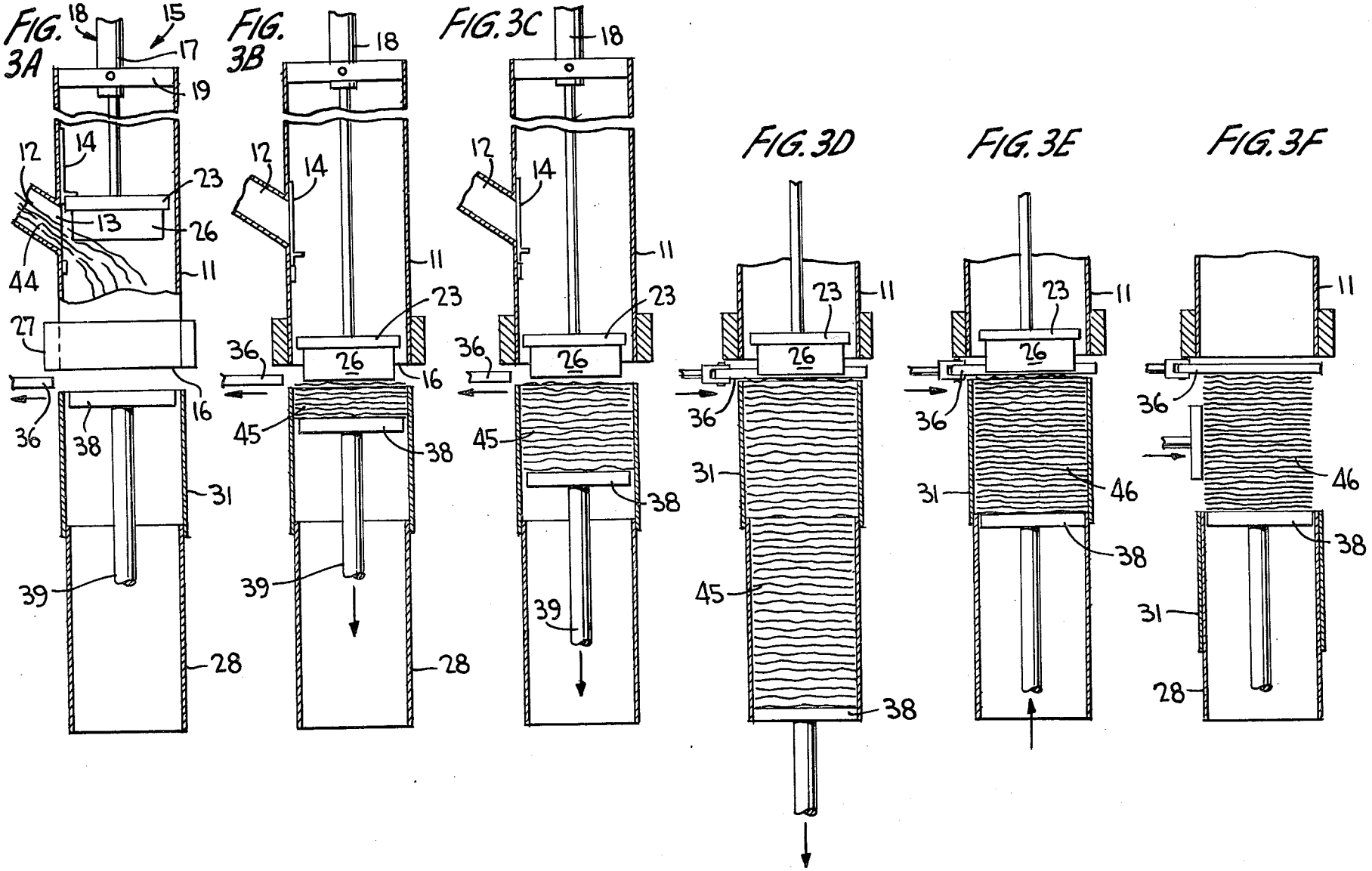
FIGS. 3A to 3F are schematic views in side elevation showing the various steps in carrying out the baling operation in accordance with the FIG. 1 apparatus.

Turning now to the drawings wherein like reference characters refer to like and corresponding parts throughout the several views, the baling press generally designated 10 in FIG. 1 my be disposed for operation either horizontally or vertically on a suitable support, and includes a lint box or hollow receptacle 11 for the reception of fibrous material through a lint slide 12. Such a box may comprise a downwardly inclined chute or slide of known construction extending from a condenser or other accumulating means or source and opening into receptacle 11. As is customary in the art, opening 13 may be closed by a sliding door 14 whenever the tramper head of the tramper, generally designated 15, moves toward its open idscharge end 16. Thus, on each downward (when the press is vertically oriented) packing movement the tramper door 14 is lowered into a position closing opening 13. Conversely, door 14 is raised into its open position as shown in FIG. 3A upon each upward movement of the tramper.

As shown in FIGS. 1 and 3, the tramper includes at least one piston and cylinder unit 17 (two being shown in FIG. 1) with the cylinders 18 thereof fixedly mounted on a cross plate 19 spanning support bars 21 mounted on opposite sides of lint box 11. Pistons 22 of the piston and cylinder unit are connected to a tramper head 23 having side rollers 24 thereon engaging bars 21 which serve as guides for the tramper during reciprocating movement thereof. Guide bars 25, mounted on the tramper head and extending through plate 19, likewise serve as guides for the tramper head during its movement. And, the tramper head is provided with axially extending prongs or plates 26.

Receptacle 11 is typically provided with a still 27 adjacent its discharge end 16, and a press box having a stationary portion 28, of a size and shape comparable to that of receptacle 11, is axially disposed relative thereto and has a still 29 fixed at one end thereof. A sliding portion 31 of the press box of a shape similar to that of box 28 but of a slightly larger size is mounted in telescoping relation to box 28 and has outwardly extending brackets 32 thereon. Posts 33 interconnect sills 27 and 29 and extend through suitable passageways provided in brackets 32 so as to permit press box 31 to be guided therealong. Hydraulic piston and cylinder units 34 interconnect press box 31 and still 27 together and are operable to effect movement of box 31 toward and away from discharge end 16 for the purpose to be described hereinafter.

Figure 2:
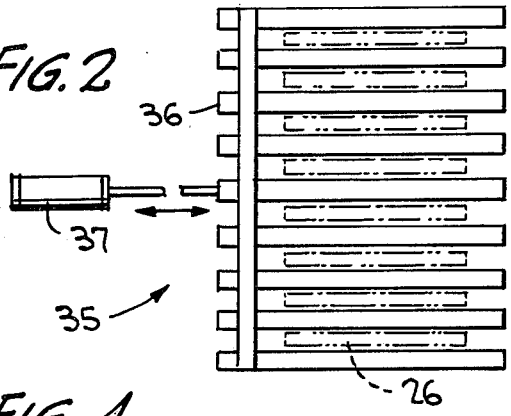
FIG. 2 is a plan view of the slotted gate taken substantially along line 2—2 of FIG. 1.

The discharge opening of lint box 11 is opened and closed by a gate means generally designated 35 and more clearly shown in FIG. 2 as comprising a slotted gate plate or fork member 36 for fully covering the discharge opening, and actuated in the direction of the double arrows shown in this Figure by means of a hydraulic piston and cylinder unit 37.

Mounted for axial movement within the press box is a ram follow block 38 connected to piston 39 extrending through sill 29 and outwardly of its cylinder 41 as part of a piston and cylinder unit or compression ram means 42. This hydraulic unit 42 is provided with suitable hydraulic valving, shown schematically at 43, such as a sequence valve which may be pilot-operated from the tramper hydraulic pressure.

In operation, fibrous material 44 is fed through slide 12 and opening 13 into lint box 11 white the tramper is in its retracted position of FIG. 3A. And, in the such position, follow block 38 and slidable press box 31 are moved by their respective piston and cylinder units 34 and 42 into a position adjacent discharge opening 16. Gate 36 is opened through movement by its piston and cylinder unit 37 in the direction of the arrow shown in FIG. 3A. Upon an inletting of a predetermined amount of fibrous material 44 into receptacle 11, tramper 15 is actuated for reciprocating movement toward discharge end 16 whereupon fibers 44 are pre-packed into a gradually increasing bale size as the tamper head reciprocates between its positions shown in FIGS. 3A and 3B. Upon a gradual increase in the size of prepacked bale 45 shown in increasing sizes in FIGS. 3B, 3C and 3D, ram follow block 38 is incrementally retracted in the direction of the arrows shown in these Figures in accordance with the increasing pre-packed bale size. This ram follow block retraction is effected by suitable hydraulic valving such as schematically shown in FIG. 1, but such valving may be in the form of a sequence valve which is pilot-operated from the tamper hydraulic pressure. Formation of the pre-packed bale from the stages shown in FIGS. 3A to 3D takes place gradually with each tramper packing stroke until ram 42 eventually "bottoms out". And, during this gradual pre-packing of the bale, the tramper will gradually reduce its outward travel to some extent until a fullsized pre-packed bale 45 as shown in FIG. 3D is formed. Then, while restraining this fully formed pre-packed bale with its prongs 26, gate 36 is closed by moving it in the direction of the arrow shown in FIG. 3D and, because of the relative spacing of prongs 26 to that of the slots formed in gate 36 (see FIG. 2), the gate may be closed without interference with the tramper prong similarly as described in the aforementioned application Ser. No. 711,338. Then, while the gate is closed, piston and cylinder unit 42 of the ram is actuated in the direction of the arrow shown in FIG. 3E so as to compress the pre-packed bale into a pressed bale 46. In the meantime, the tramper resumes its pre-packing of another batch against the closed gate so as to avoid the loss of any downtime between the completion of the final baling operation and the start of a new pre-packing operation. Piston and cylinder units 34 are then actuated to move press box 31 away from the closed gate (see FIG. 3F) so as to expose the pressed bale which may be removed from follow block 38 by means of an ejection cylinder 47 pushing in the direction of the arrow shown in FIG. 3F. Immediately upon ejection, follow block 38 and press box 31 are moved back to their positions of FIG. 3A so that, upon a reopening of gate 36, the start of forming a pre-packed bale will have already begun. The operation for the forming of further bales will when continue as aforedescribed.

It should be noted that fixed and sliding press boxes 28 and 31 may be eliminated if desired, depending on the type of fibers being compacted and the need for accurately shaped rectangular bales.

Figure 4:
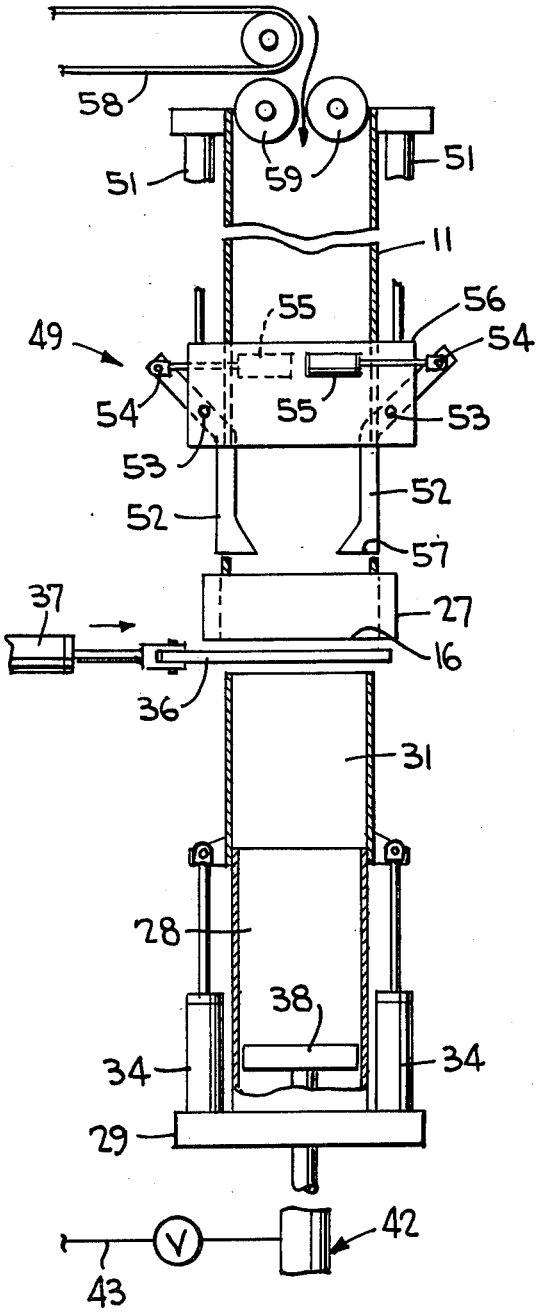
FIG. 4 is a schematic view of a baling press showing another embodiment of the baling press according to the invention.

FIG. 4 illustrates another embodiment of the baling press in accordance with the invention, such press being generally designated 48 with like parts being referred to with the same reference numerals as in FIG. 1. This press is also similar to that shown in FIG. 1 of the aforementioned related U.S. Application Ser. No. 711,338, now U.S. Pat. No. 4,041,855, except that the tramper or packing means generally designated here as 49 is mounted only for reciprocating movement on receptacle 11 and not for further incremental movement away from its discharge end 16. Tramper 49 is connected to the lint box by means of piston and cylinder units 51, and it comprises a plurality of leg members 52 mounted for pivotal movement on rods 53 at opposite sides of the lint box, the leg members also being mounted at their upper free ends for pivotal movement on rods 54. These rods are interconnected by means of hydraulic cylinders 55 located outwardly and adjacent side plates 56. And, elongated openings 57 are provided in opposing side walls of the lint box through which the leg members extend when actuated to move inwardly and outwardly of receptacle 11 upon extension and retraction of the pistons of cylinders 55, respectively. Hence, upon extension of the pistons of units 51 so as to move tramper 49 toward discharge end 16, leg members 52 are actuated so as to be moved toward one another for the purpose of pre-packing fibrous material 44 in the same manner as that described with reference to FIGS. 1 and 3A to 3F. Conversely, upon retraction of the pistons of units 51 causing tramper 49 to move away from end 16, leg members 52 are actuated to move away from one another back into their positions shown in FIG. 4. With such an arrangement, a conveyor means, in the form of an endless conveyor belt 58, may therefore be provided for continuously feeding fibrous material through the upper portion of the lint box and between rollers 59.

From the foregoing it can be seen that a baling press has been devised which substantially avoids the downtime normally occurring between the end of a final baling operation and the pre-packing of a new bale. Fiber congestion is also eliminated between the tramper head and the inlet opening with such an arrangement. The press is light in weight, compact, efficient, economical and easy to operate.

Obviously, many modifications and variations of the present invention are made possible in the light of the above teachings. It is therefore to be understood that within the scope of the appended claims the invention may be practiced otherwise than as specifically described.

What is claimed is:

1. A baling press for forming bales of fibrous material, comprising:

a receptacle having a discharge end;

infeed means on said receptacle for feeding fibrous material therethrough;

A ram follow block assembly including a follow block disposed coaxially to said receptacle and being initially located adjacent said discharge end;

reciprocable tramping means on said receptacle including a tramper head axially movable toward and away from said discharge end at a uniform stroke for forming a pre-packed bale of the fibrous material against said follow block;

at least one axial extension provided on said tramper head;

means associated with said follower block assembly for effecting incremental movement thereof away from said discharge end in response to an increasing pre-packed bale size formed against said follow block;

a gate shiftable from a position between said discharge end and said follow block to a position away therefrom for respectively closing and opening said discharge end, openings provided in said gate facilitating the closing of said discharge end as said extensions protrude therethrough beyond said dicharge end;

further means associated with said follow block assembly for moving said follow block toward said discharge end so that, with said gate closed over said discharge end, the pre-packed bale is compressed against said gate into a finally compressed bale.

2. The baling press according to claim 1, further including a compression chamber movable away from said discharge end after the pre-packed bale has been compressed into the finally compressed bale by said follow block.

3. The baling press according to claim 1, wherein said tramping means further includes a uniform stroke piston and cylinder unit, said tramper head being mounted on said piston of said unit.

4. The baling press according to claim 1, wherein said extension is defined by an axially extending prong.

5. The baling press according to claim 1, wherein said extension includes a leg member movable into and out of said receptacle from a side thereof for pre-packing the fibrous material while being fed.

6. The baling press according to claim 1, wherein a plurality of axial extensions are provided on said tramper head and includes leg members movable into and out of said receptacle from opposite sides thereof for pre-packing the fibrous material while being fed.

* * * * *